United States Patent [19]

Kanamori

[11] Patent Number: 4,705,155

[45] Date of Patent: Nov. 10, 1987

[54] BALUSTRADE OF A PASSENGER CONVEYOR

[75] Inventor: Osamu Kanamori, Inazawa, Japan

[73] Assignee: Mitsubishi Denki Kabushiki Kaisha, Japan

[21] Appl. No.: 686,680

[22] Filed: Dec. 27, 1984

[30] Foreign Application Priority Data

Dec. 29, 1983 [JP] Japan ..... 58-201566

[51] Int. Cl.[4] ..... B66B 23/24

[52] U.S. Cl. ..... 198/335; 52/397; 52/826

[58] Field of Search ..... 198/335, 337; 256/24, 256/68, 69; 52/184, 397, 400, 826; 248/74.2, 222.1

[56] References Cited

U.S. PATENT DOCUMENTS

| | | | |
|---|---|---|---|
| 3,477,751 | 11/1969 | Bos | 256/24 X |
| 3,712,447 | 1/1973 | Boltrek et al. | 198/335 |
| 3,926,296 | 12/1975 | Woodling et al. | 198/335 X |
| 3,981,118 | 9/1976 | Johnson et al. | 52/397 X |
| 4,658,946 | 4/1987 | Adrian et al. | 198/337 |

FOREIGN PATENT DOCUMENTS

| | | | |
|---|---|---|---|
| 54-55987 | 5/1979 | Japan | 198/335 |
| 55-1224 | 1/1980 | Japan . | |
| 57-180583 | 11/1982 | Japan . | |

*Primary Examiner*—Joseph E. Valenza
*Assistant Examiner*—Jonathan D. Holmes
*Attorney, Agent, or Firm*—Leydig, Voit & Mayer

[57] ABSTRACT

A balustrade of passenger conveyor comprises a guide handrail having a fitting groove for fitting the guide member onto an end of a balustrade panel, a longitudinal groove formed by a bottom wall and inner and outer side walls of the guide member, the handrail guide being formed by a material having a resilience which allows the width of the fitting groove to become small when the outer walls of the guide member are laterally displaced, and an extension member which is extendable within the longitudinal groove to laterally displace the outer side walls of the guide member. The width of the fitting groove can thus be made narrow by the action of the extension member so that the balustrade panel can be held by the inner side walls of the guide member, thereby firmly fixing the guide member to the balustrade panel.

9 Claims, 4 Drawing Figures

BALUSTRADE OF A PASSENGER CONVEYOR

BACKGROUND OF THE INVENTION

The present invention relates to a balustrade of a passenger conveyor, and more particularly, to a guide means for slidably attaching a movable handrail to the balustrade.

In a conventional balustrade of a passenger conveyor such as that shown in Japanese Patent Publication No. 55-1224, a balustrade panel made of tempered glass, etc. is disposed on the main frame of the passenger conveyor in the longitudinal direction thereof. A channel-shaped fitting member of a rigid material is fitted on the edge of the balustrade panel through a channel-shaped packing member made of an elastic material. The fitting member has an extension projecting on each side thereof and the extension is covered by a C-shaped guide rail made of a material having a low frictional coefficient such as nylon to guide thereon a moving handrail of rubber having a C-shaped cross section. The handrail is slidably fitted on the guide rails covering said extensions of the fitting member, and the open portion of the C-shaped handrail is positioned below the guide rails and the outer surface of each guide rail engages the inner surface of each side of the handrail in the longitudinal direction thereof.

However, the above-described conventional balustrade has disadvantages in that when the fitting member is press-fitted onto the balustrade panel edge through the packing member, the packing member may be damaged so that a complicated and carefully-performed operation is necessary to properly fit the fitting member onto the balustrade panel. Furthermore, since the balustrade panel is not always uniform in thickness, the fitting member may not firmly fit onto the balustrade panel, and the elastic force of the packing member for attaching the fitting member to the balustrade panel may be reduced by deterioration of the packing member due to aging even when the fitting member has originally been properly fitted on the balustrade panel.

In another conventional balustrade of a passenger conveyor of the type shown in Japanese Laid-Open Patent Publication No. 57-180583, a channel-shaped fitting member is press-fitted at its fitting groove onto a balustrade panel edge through a channel-shaped packing member, and has extensions extending on both sides of the fitting member for supporting a handrail thereon. The fitting member is attached to the balustrade panel by tightly press-fitting side wall members defining the fitting groove against the edge of the balustrade panel by bolts and nuts. The use of the bolts and nuts requires through holes in the side walls of the fitting member and notches in the packing and the panel edge. Alternatively, the pair of side wall members of the fitting member may be separated by a distance smaller than the thickness of the balustrade panel edge so that they are press-fit on the edge by the elasticity of the material.

However, with the structure using tightening bolts, since the above-mentioned through holes and the notches must be provided in the fitting member, the packing member and the balustrade panel plate, the balustrade has the disadvantage that it is difficult to manufacture and assemble the fitting member, the packing member, and the balustrade panel. A balustrade of the latter type has disadvantages that the packing member may be damaged when the fitting member with side walls is press-fit onto the balustrade panel, and the required press-fitting accuracy is very severe and that the differing thickness of the balustrade panel edge and the aging of the elastic material make the balustrade less reliable.

SUMMARY OF THE INVENTION

Therefore, an object of the present invention is to provide a balustrade of a passenger conveyor in which a guide rail for guiding a handrail thereon can be easily and reliably mounted on an edge of the balustrade panel.

Another object of the present invention is to provide a balustrade of a passenger conveyor in which when a guide rail for guiding a handrail thereon is fitted onto an edge of the balustrade panel through a packing member, the packing member is not damaged and the complicated processing of the guide means, the packing member and the balustrade plate is not necessary to attach the guide rail onto the balustrade panel.

With the above objects in view, the present invention resides in a balustrade of a passenger conveyor comprising a balustrade panel disposed along a main frame of the passenger conveyor, a handrail guide attached on an edge of the balustrade panel, the handrail guide including a channel member having a substantially U-shaped cross section having a pair of spaced side wall members straddling the panel and having a predetermined distance therebetween and a bottom wall member between the side wall members defining a closed end of the channel member and contacting the panel edge, extension wall members laterally disposed on both sides of the channel member and extending vertically above the closed end of the channel member, the extension wall members and the channel member walls forming walls defining a longitudinal groove therebetween, said bottom wall member, and a guide rail disposed on the extension wall members, a moving handrail supported and guided by the guide rail of the handrail guide for movement along the edge of the balustrade panel, and separating means disposed in the space between the extension wall members of the handrail guide for further spacing, when extended, the extension wall members from each other, thereby urging the side wall members against the edge of the balustrade panel, the handrail guide having a rigidity suitable for allowing the channel member to laterally contract to decrease the distance between the side wall members when the extension wall members are separated, thereby firmly gripping the edge of the balustrade by the side wall members.

BRIEF DESCRIPTION OF THE DRAWINGS

The invention will become more readily apparent from the following description of the preferred embodiments thereof taken in conjunction with the accompanying drawings, in which.

DESCRIPTION OF THE PREFERRED EMBODIMENTS

Figure 1:
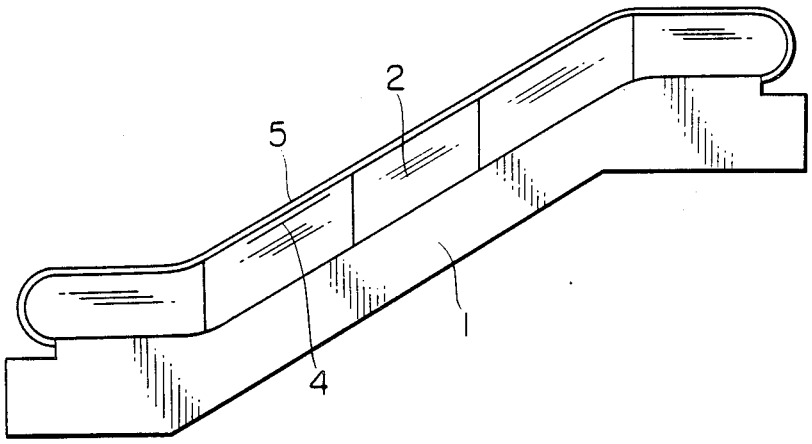
FIG. 1 is a side view of a passenger conveyor.
Figure 2:
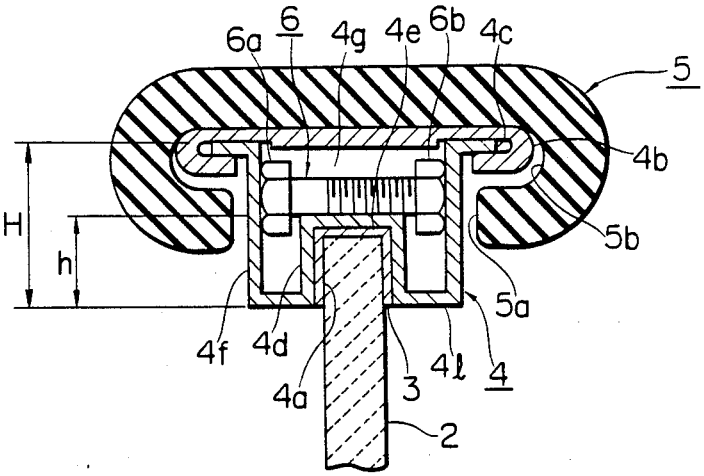
FIG. 2 is a sectional view showing one embodiment of a balustrade of passenger conveyor according to the present invention.

Referring now to FIGS. 1 and 2, a balustrade panel 2 made of transparent tempered glass, for example, is disposed on a main frame 1 of a passenger conveyor in the longitudinal direction thereof. A handrail guide or a fitting member 4, which is preferably formed by a relatively thin plate made by the extrusion of a material such as aluminum, stainless steel or synthetic resin, has a bottom wall 4*e* and a pair of inner side walls 4*d* forming a fitting groove 4*a* for fitting the fitting member 4 onto the upper edge of the balustrade panel 2. In other words, the handrail guide 4 may be said to include a channel member of a substantially U-shaped cross section which straddles the panel 2. The channel member includes the pair of separated side walls 4*d* and the bottom wall 4*e* between them, the bottom wall forming the closed end of the channel member and contacting the panel edge. The inner side walls 4*d* are connected with the bottom wall 4*e*, the upper surface of which is located at a distance h from an open end of the fitting groove 4*a*. The fitting member 4 also has a pair of spaced outer side walls 4*f*, disposed on both sides of, and formed integrally with, the channel member and having lower ends which are respectively connected to the lower ends of the inner side walls 4*d* by lowermost walls 4*l*. The outer side walls 4*f* are located outside the inner side wall 4*d*. The lower ends thereof are flush with the lower ends of the inner side walls 4*d*, and the upper ends of the outer side walls extend a distance H from the lower ends of the same, which is greater than the distance h. Thus, the outer side walls 4*f* and the lower walls 4*l* may be referred to as extension wall members. A longitudinal groove 4*g* which extends along the longitudinal direction of the balustrade panel 2 is formed by the bottom wall 4*e*, the inner side walls 4*d*, the lowermost walls 4*l*, and the outer side walls 4*f*. Mounting means for slidably mounting a handrail 5 on the handrail guide includes projections or engaging portions 4*c* on which a guide rail 4*b* is mounted and, for this purpose, engaging portions 4*c* project laterally outwardly from the upper ends of the outer side walls 4*f* The guide rail 4*b* has a C-shaped cross section and is supported by the fitting member 4 where the curved ends of the guide rail 4*b* enclose the engaging portions 4*c*, the distance between the laterally opposed inner surfaces of the C-shaped guide rail being greater than the overall lateral span of the engaging portions to allow for a lateral expansion of the latter.

An extending member 6 disposed within the longitudinal groove 4*g* and extendable in a lateral direction preferably comprises a bolt 6*a* and a nut 6*b* screwed thereon, the bolt 6*a* pointing in the widthwise direction of the longitudinal groove 4*g*. The head portion of the bolt 6*a* abuts the inner surface of one of the outer side walls 4*f*, and the shank portion of the bolt 6*a* preferably lies flat against the upper surface of the bottom wall 4*e*. The nut 6*b* abuts the inner surface of the other outer side wall 4*f*. The extending member 6, extension wall members, and the connection of the latter to the inner side walls 4*d* by lowermost walls 4*e* comprise a means by which the channel member can be made to laterally contract and grip the panel. The handrail 5 made of rubber has a C-shaped cross section and is slidably fitted onto the guide rail 4*b* so that the edges of the handrail 5 are positioned below the guide rail 4*b* and the curved ends of the guide rail 4*b* can engage with respective inner surfaces 5*b* of the curved ends of the handrail 5. The fitting member 4 and the guide rail 4*b* disposed thereon form a guide means which is fitted onto the balustrade panel 2 and slidably guides the handrail thereon. In addition, the fitting member 4 is made of a handrail guide which allows the fitting groove 4*a* to laterally contract when the outer side walls 4*f* of the fitting member 4 are laterally displaced outwardly.

Figure 3:
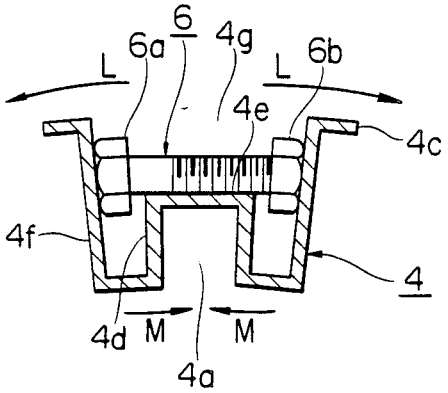
FIG. 3 is a sectional view showing a state in which a fitting member is bent by an extension member.

In the operation of the present balustrade, the fitting member 4 is positioned on the balustrade panel 3 by fitting the end of the balustrade panel 2 into the fitting groove 4*a* through a packing member 3 made of an elastic material The extending member 6 disposed laterally across the longitudinal groove 4*g* is then extended by rotating the nut 6*b* with respect to the bolt 6*a* so as to laterally displace the outer side walls 4*f* outwardly in the directions shown by arrows L in FIG. 3. Accordingly, by the lateral displacement of the extension wall members, the longitudinal groove 4*g* is laterally expanded while the fitting groove 4*a* is laterally contracted, as shown by arrows M in FIG. 3. Thus, the edge of the balustrade panel 2 is securely gripped by the inner side walls 4*d*so that the fitting member 4 is firmly secured to the balustrade panel 2. Since the fitting member 4 is fitted onto the balustrade panel 2 in this manner, the packing member 3 is not damaged at all, and the fitting member 4 is reliably secured to the balustrade panel 2 by making the width of the fitting groove 4*a* narrow even when the thickness of the balustrade panel 2 is not uniform, obtaining a balustrade having no disadvantages caused by the guide means being imperfectly secured to the balustrade panel end. Accordingly, the fitting member 4 can be firmly secured to the balustrade panel end at all times irrespective of the aging of the packing member 3.

In the above embodiment, it is clear that the same effects can be obtained when the fitting member 4 is formed by the extrusion of a synthetic resin.

Figure 4:
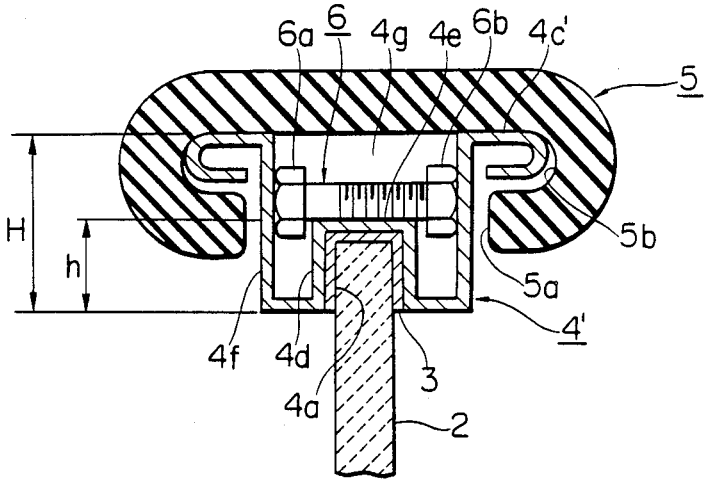
FIG. 4 is a sectional view showing another embodiment of a balustrade of passenger conveyor according to the present invention.

FIG. 4 illustrates another embodiment of a balustrade according to the present invention, where the same reference numerals used in FIG. 2 refer to corresponding elements. In this embodiment, the mounting means comprises simply a pair of engaging portions 4*c*′ which extend laterally from the outer side walls 4*f* at the upper ends thereof. The engaging portions have C-shaped cross sections and guide the handrail 5 thereon, the distance between the laterally opposed inner surfaces 5*b* of the handrail being greater than the overall lateral span of the engaging portions to allow for the lateral displacement of the extension walls. The engaging portions 4*c*′ therefore perform the functions of both the engaging portions 4*c* and the guide rail 4*b* in FIG. 2. It is to be understood that effects similar to those stated with respect to FIG. 2 are obtained, since an extending member 6 is also disposed widthwise within the longitudinal groove 4*g* as mentioned above.

As stated above, a balustrade of a passenger conveyor according to the present invention comprises guide means having a fitting groove for fitting the guide means onto an end of a balustrade panel and a longitudinal groove formed by the bottom wall and inner and outer side walls of the guide means, the guide means being formed from a material which allows the width of the fitting groove to become small when the outer side walls are laterally displaced, and an extending member which is extendable within the longitudinal groove to laterally displace the outer side walls outwardly so as to laterally expand the longitudinal groove. Accordingly, the fitting groove can be laterally contracted by the action of the extending member so that the balustrade panel can be held by the inner side walls of the guide means. Thus, the fitting member is reliably secured to the balustrade panel even when these members are not precisely manufactured, thereby obtaining a balustrade of a passenger conveyor having no disadvantages caused by the fitting member being imperfectly secured to the balustrade panel.

What is claimed is:

1. A balustrade for a passenger conveyor comprising:

a balustrade panel longitudinally disposed in a vertical plane along a main frame of the passenger conveyor;

a handrail guide attached on an edge of said balustrade panel for slidably supporting and guiding a moving handrail for movement along the panel edge, said handrail guide including:

a channel member having a substantially U-shaped cross section having a pair of spaced side wall members disposed in substantially vertical planes and having a predetermined distance therebetween and straddling said balustrade panel, said channel member having a bottom wall member between said side wall members;

extension wall members disposed on both sides of, and formed integrally with, said channel member and having outer walls spaced laterally from, and connected to, both side wall members of said channel member and extending vertically above said bottom wall member whereby said extension wall members, as formed with said channel member, have a given spacing therebetween;

a guide rail disposed on said extension wall members for guiding the handrail; and separating means disposed in the space between, and transverse to, said extension wall members and extendable in the transverse direction to engage and further space, when extended, said extension wall members from each other, thus causing the side wall members of said channel member to contract and grip said balustrade panel straddled therebetween, said handrail guide having a rigidity allowing said channel member to contract to decrease said distance between said side wall members when said extension wall members are further spaced by said separating means, thereby firmly gripping said balustrade panel by said side wall members.

2. A balustrade for a passenger conveyor as claimed in claim 1 wherein said handrail guide is formed by the extrusion of aluminum, stainless steel, or synthetic resin.

3. A balustrade of a passenger conveyor including:

a balustrade panel longitudinally disposed in a vertical plane along a main frame of the passenger conveyor;

a handrail guide secured to an edge of said balustrade panel and providing a support for a handrail having a C-shaped cross section and being slidably fitted on said handrail guide for movement along the panel edge;

said handrail guide comprising:

means defining a fitting groove including a U-shaped channel member mounted on the panel edge and having walls straddling said panel therebetween which, when laterally contracted, firmly secure said handrail guide to said panel, said channel member having an interior surface of a vertically uppermost closed end proximately disposed to the panel edge, said channel member being oriented relative to said panel such that it opens in a vertically downward direction straddling said panel;

means for laterally contracting said channel member walls and firmly securing said handrail guide to said panel, said means for contracting including:

extension wall members laterally disposed on both sides of said channel member, said extension wall members and said channel member walls forming walls defining a longitudinal groove therebetween, a connection between said extension wall members and said channel member, and extending means disposed in said longitudinal groove and located between, and abutting, inner surfaces of said extension wall members, said extending means being extendable to laterally displace said extension walls, thus laterally expanding said longitudinal groove and causing, by said connection between said extension walls and said channel member, said channel member walls to laterally contract about, and securely grip, said balustrade panel straddled therebetween.

4. A balustrade for a passenger conveyor as claimed in claim 3 wherein said extending means comprises a bolt and a nut screwed thereon, both ends of said bolt being disposed to face the inner surfaces of said extension wall members of said means for contracting.

5. A balustrade for a passenger conveyor as claimed in claim 3 wherein said handrail guide is secured onto the balustrade panel edge through a buffer member of an elastic material.

6. A balustrade for a passenger conveyor as claimed in claim 3 wherein said handrail guide is formed by the extrusion of aluminum, stainless steel, or synthetic resin.

7. A balustrade of a passenger conveyor as claimed in claim 3 wherein said handrail guide includes mounting means for slidably fitting the handrail on said handrail guide, said mounting means including engaging portions projecting laterally from said extension walls, said engaging portions having an overall lateral span smaller than a distance existing between laterally opposed inner surfaces of the C-shaped handrail to allow for the lateral displacement of said extension walls.

8. A balustrade of a passenger conveyor as claimed in claim 7 wherein said mounting means includes a guide rail for slidably fitting the handrail thereon, said guide rail having a C-shaped cross section with curved ends which enclose said engaging portions to mount said guide rail thereon, said guide rails, thus formed, having a distance between laterally opposed inner surfaces thereof greater than the overall lateral span of said engaging portions to allow for the lateral displacement of said extension walls.

9. A balustrade of a passenger conveyor as claimed in claim 7 wherein said engaging portions have C-shaped cross sections, the handrail being mounted directly thereon.

* * * * *